US005295320A

United States Patent [19]

Svensson

[11] Patent Number: 5,295,320

[45] Date of Patent: Mar. 22, 1994

[54] MAGAZINE FOR RAPID SHOT FIREARM AND FIREARM

[76] Inventor: Sten M. C. Svensson, 180 N. Woodland St., Englewood, N.J. 07631

[21] Appl. No.: 895,789

[22] Filed: Jun. 9, 1992

[51] Int. Cl.[5] ..... F41A 9/79

[52] U.S. Cl. ..... 42/49.01; 89/33.03; 89/35.01

[58] Field of Search ..... 42/6, 49.01, 50, 7; 89/13.05, 33.03, 35.01

[56] References Cited

U.S. PATENT DOCUMENTS

| | | | |
|---|---|---|---|
| 386,535 | 7/1888 | Graham | 42/60 |
| 476,591 | 6/1892 | Archbold | 42/60 |
| 630,758 | 8/1899 | Turnbull | 89/33.03 |
| 672,300 | 4/1901 | Turnbull | 42/39.5 |
| 1,787,354 | 12/1930 | Bochnak | 42/59 |
| 4,426,802 | 1/1984 | Walker | 42/59 |

FOREIGN PATENT DOCUMENTS

| | | | |
|---|---|---|---|
| 2845723 | 4/1980 | Fed. Rep. of Germany | 89/33.03 |
| 326316 | 2/1903 | France | 42/7 |
| 17004 | of 1916 | United Kingdom | 89/13.05 |

*Primary Examiner*—Stephen C. Bentley
*Attorney, Agent, or Firm*—Klauber & Jackson

[57] ABSTRACT

The invention described herein relates to a magazine for a rapid shot firearm, and the firearm in which such magazine is used. The magazine contains a number of segments, which may be pivotally joined together, as appropriate, housed within a casing. The segments in the preferred embodiment of the invention form a belt which is rotatably mounted within the magazine.

The firearm which uses the magazine has a rotating means for rotating the belt between shots. The firearm is thus useful to avoid jamming where due to misfires.

7 Claims, 8 Drawing Sheets

MAGAZINE FOR RAPID SHOT FIREARM AND FIREARM

The invention described herein relates to a magazine for a rapid type firearm in which the magazine is journaled in the weapon. The firearm provides an easily removable and replaceable magazine or clip that functions essentially like a revolver cylinder when mounted within the firearm, without the possibility of jamming, as may occur with conventional automatic and semi-automatic weaponry.

In contrast to conventional weaponry, the repeating firearm described herein enables the user to bypass a misfired cartridge and still maintain the capability to rapidly exchange a spent magazine for a fresh, fully loaded clip. Also, a notably larger capacity is available than that of a practically sized cylinder.

The magazine can accommodate a low bore axis, either configured in front of the trigger guard, or within the grip, thus reducing perceived recoil and the upward component of the recoil upon firing, thereby allowing much more rapid re-acquisition of the target for subsequent shots.

The firearm described herein is extremely reliable. A principle advantage over the standard replaceable clip automatic or semi-automatic pistol is greater reliability. This improvement is due both to a design that eliminates the cycling errors to which these conventional automatic weapons are prone, and to the ability to bypass faulty ammunition. With conventional automatic weaponry, when a cartridge fails to fire, the weapon jams and becomes unusable until the unspent, misfired cartridge is cleared. This may entail disassembly of the weapon, removal of the unspent cartridge and reassembly.

OBJECTS OF THE INVENTION

One object of the present invention is thus to provide a firearm which does not jam when a cartridge fails to discharge.

Another object of the present invention is to provide a firearm which is as reliable as a revolver, but easier and faster to reload.

Another object of the present invention is to provide interchangeability of short (lower capacity) magazines that provide a more readily concealable, sized pistol, with longer (higher capacity) magazines.

Another object of the present invention is to provide a mechanism which can be readily modified to be useful in rifles, shotguns and the like.

These and other objects will be apparent to those of ordinary skill in the art from the teachings herein.

SUMMARY OF THE INVENTION

A firearm is disclosed which is comprised of a frame, a barrel, a firing mechanism and a securing means for a magazine. The firing mechanism is comprised of a trigger, a hammer and a firing pin. The firing mechanism is operatively mounted in the frame and adapted to fire a cartridge contained within the chamber of a segment of a belt, which is housed within a magazine casing.

The magazine is comprised of a casing, an inner wall and a continuous belt of pivotally attached segments. Each segment has a chamber contained therein pointing in the forward direction. The belt of the magazine is rotatable in use, in a direction generally perpendicular relative to the frame, such that each successive chamber can be aligned with the barrel and the firing pin.

The means for rotating the belt of the magazine in the perpendicular direction relative to the frame positionally aligns each chamber with the barrel and firing pin prior to firing, and then rotates the magazine sufficiently to position a subsequent segment and chamber contained therein in the same manner.

The means for securing the segment of the belt to momentarily prevent rotation of said belt holds the segment and chamber contained therein in alignment with the barrel and firing pin during firing. It then releases the belt to permit rotation of the belt and alignment of the subsequent segment and chamber with the barrel and firing pin.

BRIEF DESCRIPTION OF THE DRAWINGS

The invention is described herein in detail in connection with the following drawings, in which.

DETAILED DESCRIPTION

Figure 1:
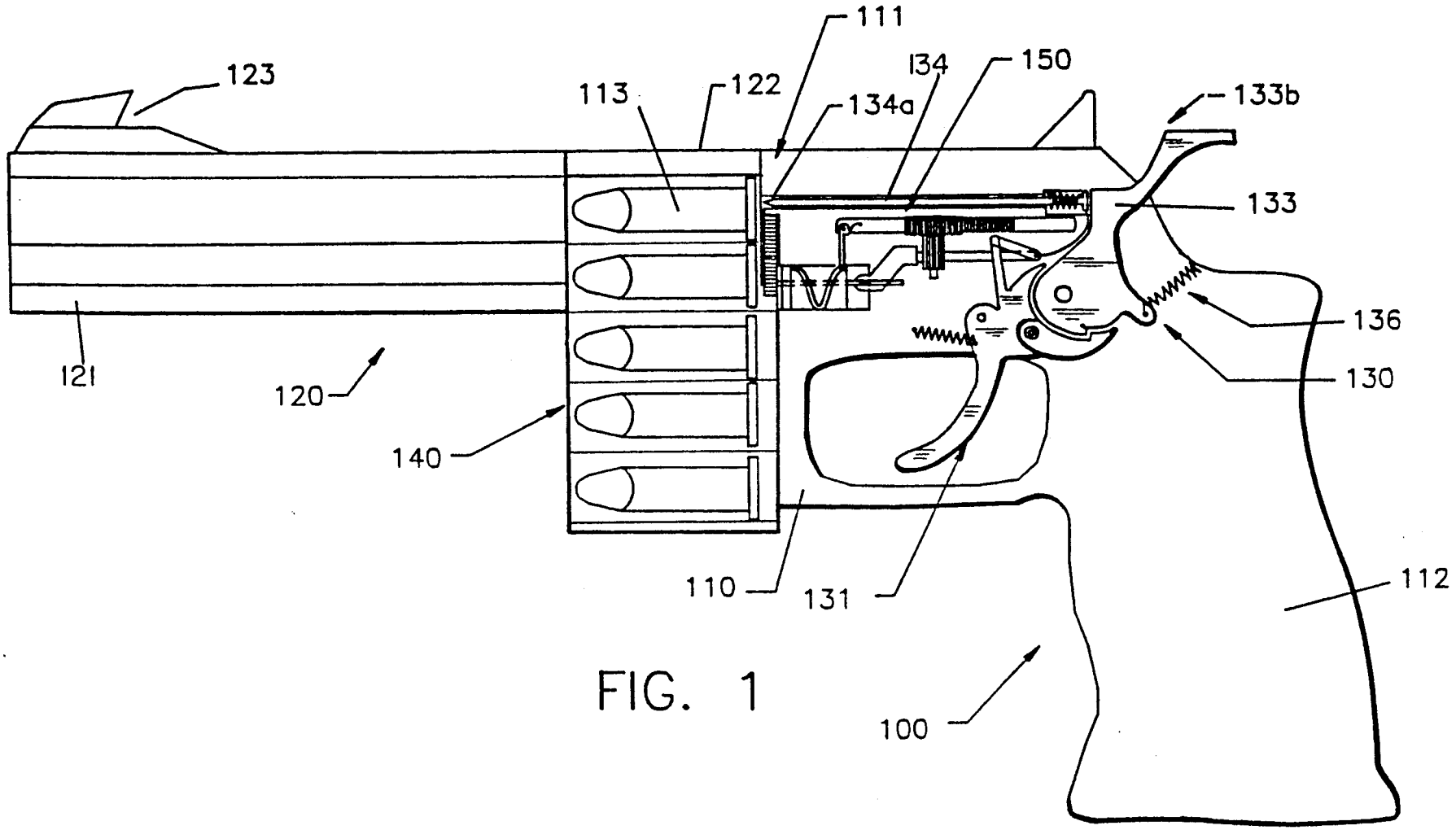
FIG. 1 is a cross-sectional side view of a repeat firearm containing the the tractor clip of invention forward of the trigger assembly.
Figure 2:
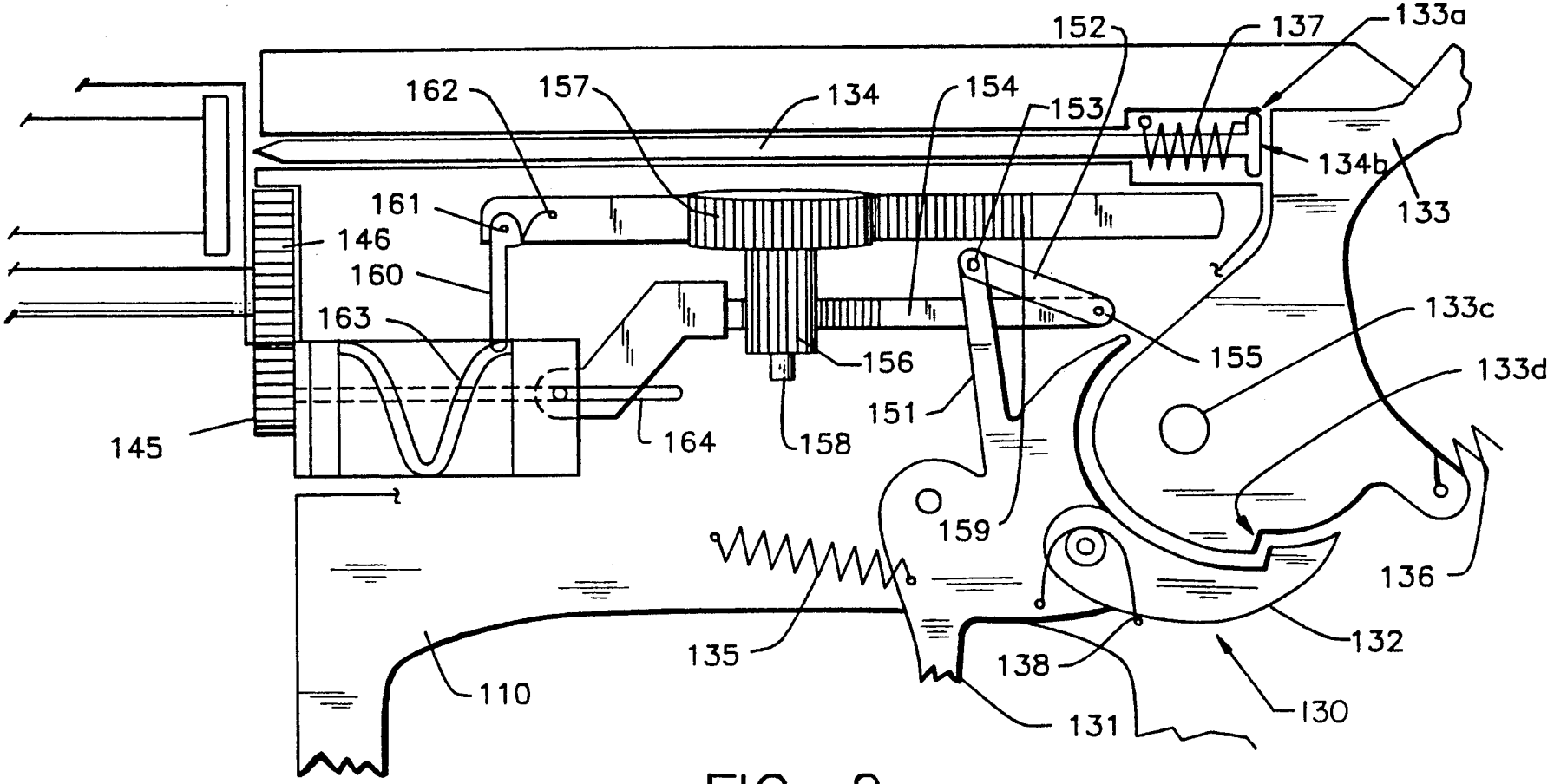
FIG. 2 is a detailed partial side view of the firearm in cross section, showing a rotating means in the form of a preferred drive mechanism.

Referring in detail to the drawings, a repeat firearm is shown generally as 100. The firearm may generally be comprised of a frame 110, a barrel 120, a firing mechanism 130, a magazine 140, a rotating means 150 and a securing means 170.

The frame supports the component parts of the weapon and provides the user with stability in the weapon. For purposes of describing the invention, the frame may include a front portion 111 which holds the magazine casing, the rotating means and securing means. Additionally, for purposes of completeness, the frame may include the butt or stock (not shown) of the weapon. For purposes of illustration, but not by way of limitation, the drawings portray a pistol with a handle 112 which can be comprised of any suitable material, wood, metal, plastic, etc.

The frame also secures the barrel 120 of the weapon. The barrel typically has a forward end 121 and a rearward end 122 in which the cartridges are loaded by the tractor clip described herein. The forward end of the barrel may be adapted to use a sight 123 or the upper (outer) surface of the barrel may be adapted to accommodate a sighting device (not shown). The caliber of the weapon may be changed by changing the barrel and by using a correspondingly different clip.

The weapon is suitable for any conventional size cartridge, depending on the barrel bore, and the overall suitability of the weapon for large or small bore weapons. While the cartridges 113 pictured are 0.357 cartridges, other calibers are possible and within the scope of this invention.

The firing mechanism 130 may be conventional or may be particularly suited to use with the tractor clip mechanism described herein. For purposes of illustration, the firing mechanism typically includes a trigger 131, a trigger pawl 132, a hammer 133, a firing pin 134, a trigger return spring 135, a hammer drive spring 136, a firing pin spring 137 and a trigger pawl tension spring 138.

The trigger is pivotally attached to the trigger pawl to provide some play in the trigger without creating nonresponsiveness in the weapon. Resistance is created by means of a trigger tension spring 138 which can have any desired tension.

The hammer may also be conventional in its overall size, configuration and use, or may be particularly adapted for use with the tractor clip described below. The hammer typically has a firing pin striking surface 133*a*, a thumb draw 133*b*, a hammer pivot point 133*c*, and a pawl interrelating area 133*d* which coordinates with the overall size and shape of the trigger pawl.

The firing pin 134 may be "nail-like" in appearance, with a forward point 134*a* which drives forward, contacting the cap of the cartridge when the hammer strikes the firing pin contact surface 134*b*. The firing pin is typically a solid metal. The firing pin is caused to retract to its original position by the firing pin spring 137.

The trigger return spring 135 may be attached to the frame at its forward end, and to the trigger at its back end. The trigger return spring pulls the trigger back to its forward position after the trigger has been squeezed. The greater the pressure, the greater the force with which the trigger returns to its resting position.

The hammer drive spring likewise exerts pressure against the trigger. As the trigger is pulled, the hammer rotates on its pivot point, causing the drive spring to stretch to a point where the trigger pawl disengages from the hammer. This allows the hammer drive spring to rotatably drive the hammer into the back end of the firing pin.

The forward point 134*a* of the firing pin thus contacts the cap of the cartridge which is in the firing position when the firing pin is driven forward. As will be appreciated, when the trigger is pulled in the usual manner, the trigger extension finger exerts force on the radius adjuster L bar 152, which is further described below, thereby pulling the lower linear gear bar 154 forward. This in turn may cause two separate actions: the rotating means is put into motion and the securing means is unlocked, thus allowing the rotating means to advance the belt and position a segment thereof to allow the fresh cartridge contained therein to be aligned, locked and then fired.

As will also be appreciated, a trigger pull causes the lower linear gear bar to move forward, which in turn causes the semi-cylinder finger to push on a lip near the end of the forward end of the worm gear lock lever out of the index in the worm gear, thus allowing the worm gear to be driven by the forward motion of the drive finger pin.

The magazine is shown generally as 140, and is comprised of a casing 142. The casing may contain an outer wall 142*a* and a plurality of segments 141, each of which is suitable in size and shape to house a cartridge in a chamber. The segments are pivotally joined together in the form of a continuous belt or track with at least one or a plurality of pivotable joints 141*a* between adjacent segments. As can best be seen in FIGS. 8 and 9, each segment can have the same overall shape or the segments can be sculpted to intermesh with the adjacent segment ("head to tail"). In one of the preferred embodiments of the invention, the magazine contains as many as 8 to 12 segments.

Figure 7:
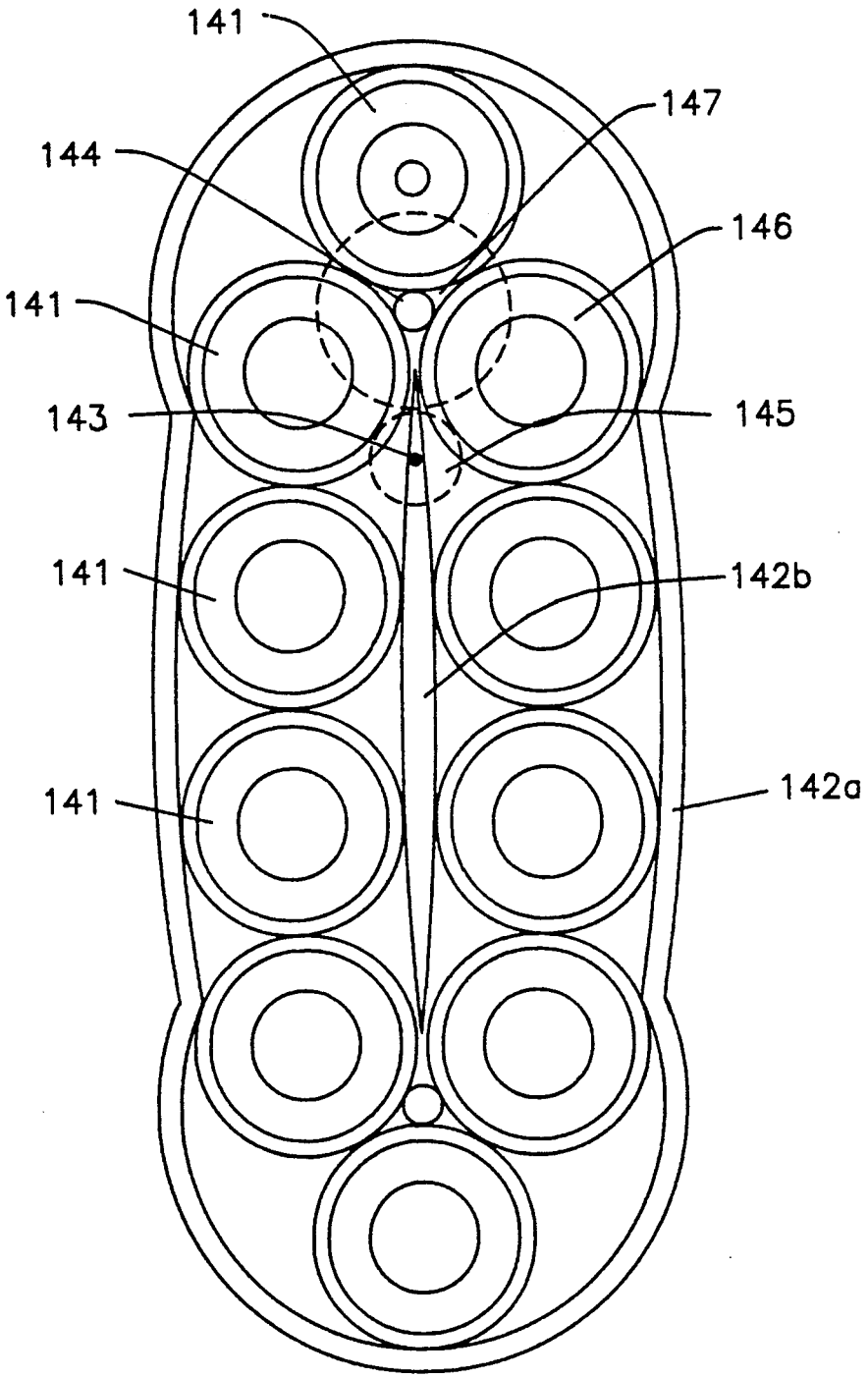
FIG. 7 is a front view of one configuration of the tractor clip.
Figure 8:
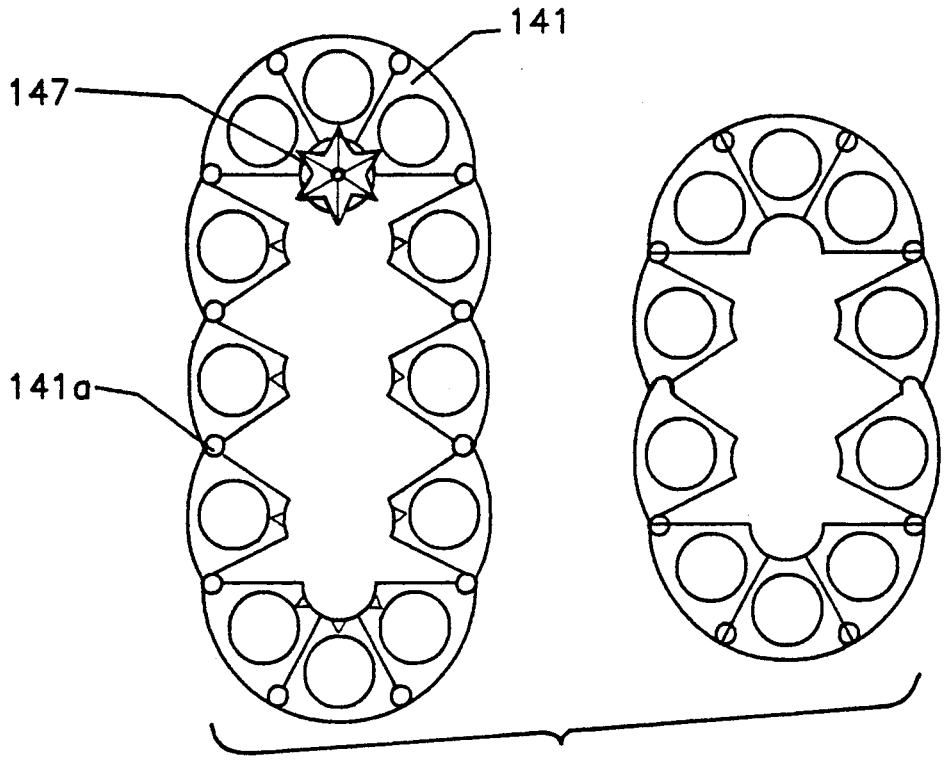
FIG. 8 contains two alternative embodiments of tractor clips in cross-section having 10 and 12 segments and solid segment wings, respectively.
Figure 9:
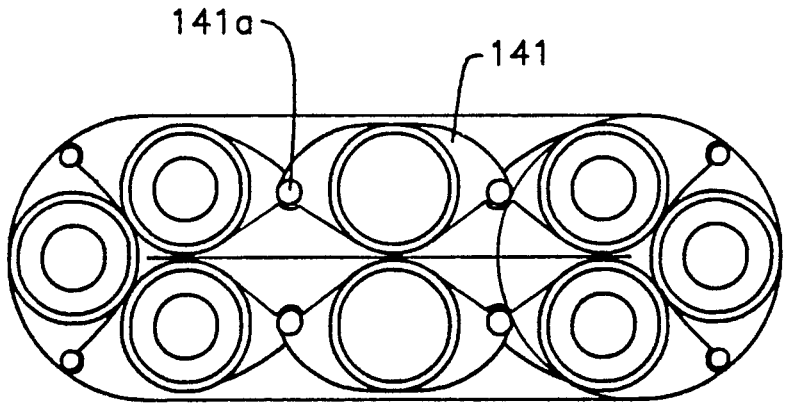
FIG. 9 is an alternative embodiment of the tractor clip in cross section having movable segment wings.

The most preferred configuration for the segments is shown in FIGS. 7 and 8 with the pivot points 141*a* in the form of hinges. The segments can be cast or molded and comprised of metal, plastic, ceramic or a composite, and are thus suitable for reloading or reuse, or disposable after the magazine or belt contained within the casing is used. The most preferred segment design is shown in FIG. 8, and is a frusto-wedge shaped design when viewed from the front or back, with an overall angle that accommodates the radius at the top and bottom of the belt, for example, allowing three or more segments to complete a half circle at the top and bottom of the belt.

The magazine 140 is optimally constructed to have an outer wall, the casing 142 and an inner wall 142*b*. The inner wall forms a divider through the long axis of the magazine and is affixed to any or all of the magazine components as necessary to render the magazine useful. The belt may slidably engage the inner surface of the casing and the outer surface of the inner wall if desired, to facilitate the rotation of the belt and the advancement of the segments.

At the top of the magazine, within the interior of the continuous belt, may be situated a segment drive propeller 147. The segment drive propeller causes the belt to rotate by exerting force upon the segments at the top of the belt, where the cartridges are presented for firing. The segment drive propeller is typically shaped to cooperate with the segment surface which is presented as the belt rotates, thus enabling the drive propeller to cooperate with the segments and cause rotation of the belt.

For example, if the segment surface with which the drive propeller cooperates is grooved, and three segments are situated as shown in FIG. 8 at the top, with curved inner surfaces, a drive propeller which is compatably shaped in cross section can be used. Likewise, if the segments are round in cross section, as shown in FIG. 7, the segment drive propeller can be generally triangular but with concave surfaces to interact with the segment surface contacted.

The belt which is contained within the magazine is rotated within the magazine by activation of rotating means 150. While the drive propeller functions to rotate the belt, it is described as part of the magazine for purposes of illustration only. The rotating means is found within the weapon, for purposes of description only, and can be any mechanism by which the belt is advanced to facilitate the rapid change of spent (or misfired) cartridges for new.

The preferred rotating means is responsive to repeated trigger pulls, as opposed to a single trigger pull causing the weapon to fire automatically. In the most preferred rotating means, the trigger is configured to provide a trigger extension finger 151 at the top thereof. In the resting position, the trigger extension finger is pointing generally upward, where it pivotally joins a radius adjuster L-bar 152 by means of a short pin 153. The radius adjuster L-bar in turn may pivotally join a lower linear gear bar 154 by means of a long pin 155. As the lower linear gear bar moves in the forward direction, it cooperates with small circular gear 156, Which in turn causes the large circular gear 157 to rotate. The small and large circular gears may share a common axis in circular gear pivot pin 158. The large circular gear in turn cooperates with the upper linear gear bar 159. The upper linear gear bar points in the forward direction, and cooperates with a worm gear drive finger 160. The worm gear drive finger may be pivotally attached to the forward end of the upper linear gear bar by means of drive finger pin 161. The pivotal attachment can be controlled by means of a retaining spring 162.

The worm gear drive finger extends downward and the downward tip thereof slidably engages worm gear 163 which is rotatably situated on worm gear pivot pin 164 and which in turn causes the belt and segment gears to rotate.

Figure 6:
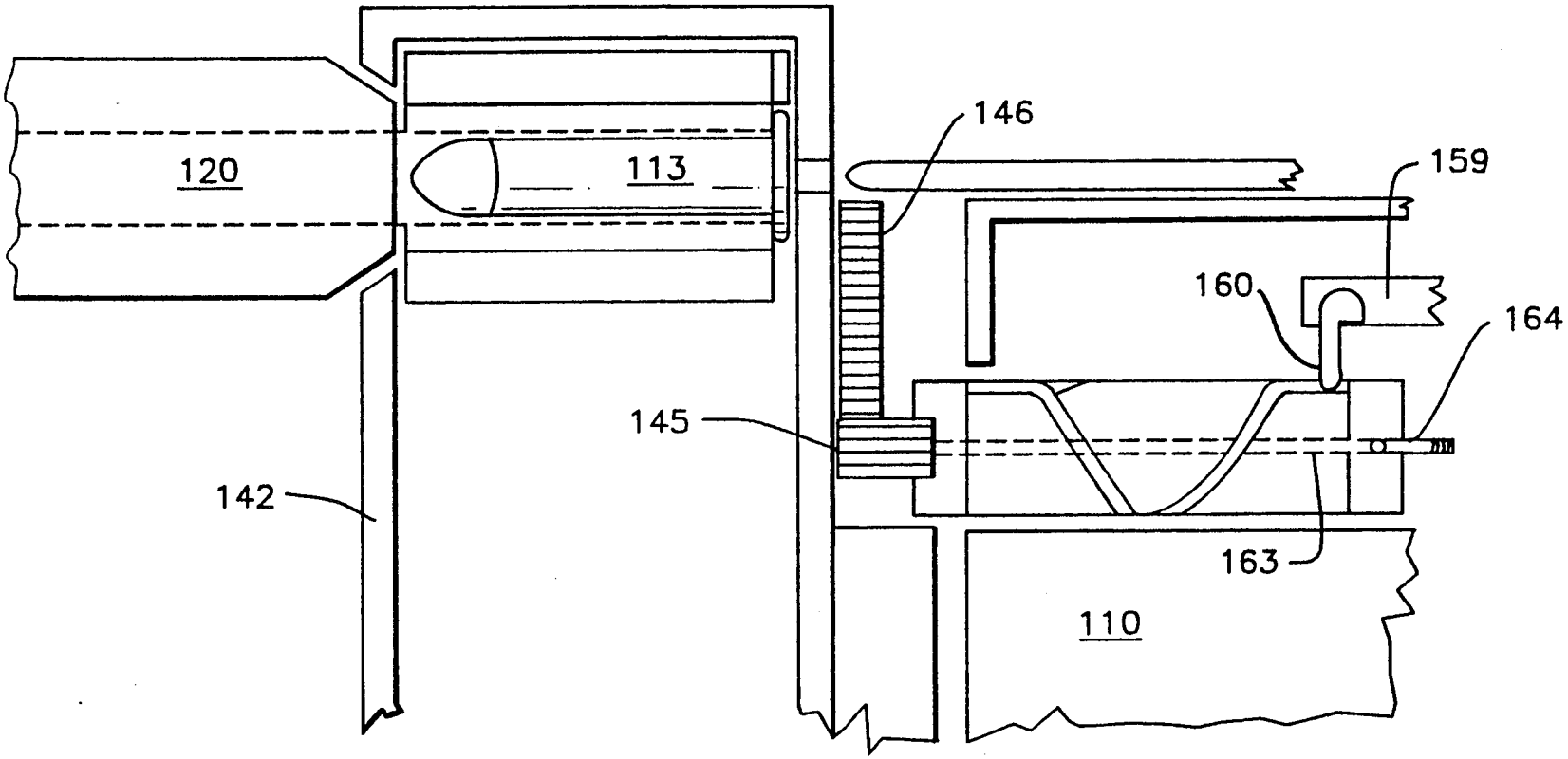
FIG. 6 is a detailed side view of the worm gear as shown in FIG. 4.

As shown in detail in FIG. 6, the worm gear may have a "screw-driver type" head at the forward end, which may be engaged by a complimentarily configured interface of the drive gear. Engagement causes this gear to likewise rotate. The belt drive gear can be affixed to the outside surface of the casing by means of a magazine screw. The belt drive gear can thereby mesh with the segment drive gear, which is preferably larger in diameter.

In the most preferred embodiment, the circumference of the segment drive gear is about three times the circumference of the belt drive gear. This assures that the segment drive gear moves about a third of a rotation for every full turn of the belt drive gear This is consistent and preferable when the upper end of the belt is as shown in the drawings, with three segments forming the upper semicircular portion.

As shown in detail in FIG. 7, as the segment drive gear turns, it turns the segment drive propeller. The segment drive propeller is configured along its long axis to cradle the cartridge segments 26 at the top of the belt. Hence, if three segments appear at the top of the belt as shown, the segment drive propeller will optimally be a three sided structure, with each side having a configuration that matches the configuration of the segment surface with which it interacts. Thus, as shown, each side of the segment drive propeller, which is triangular in the drawings, appears to be concave.

Figure 5:
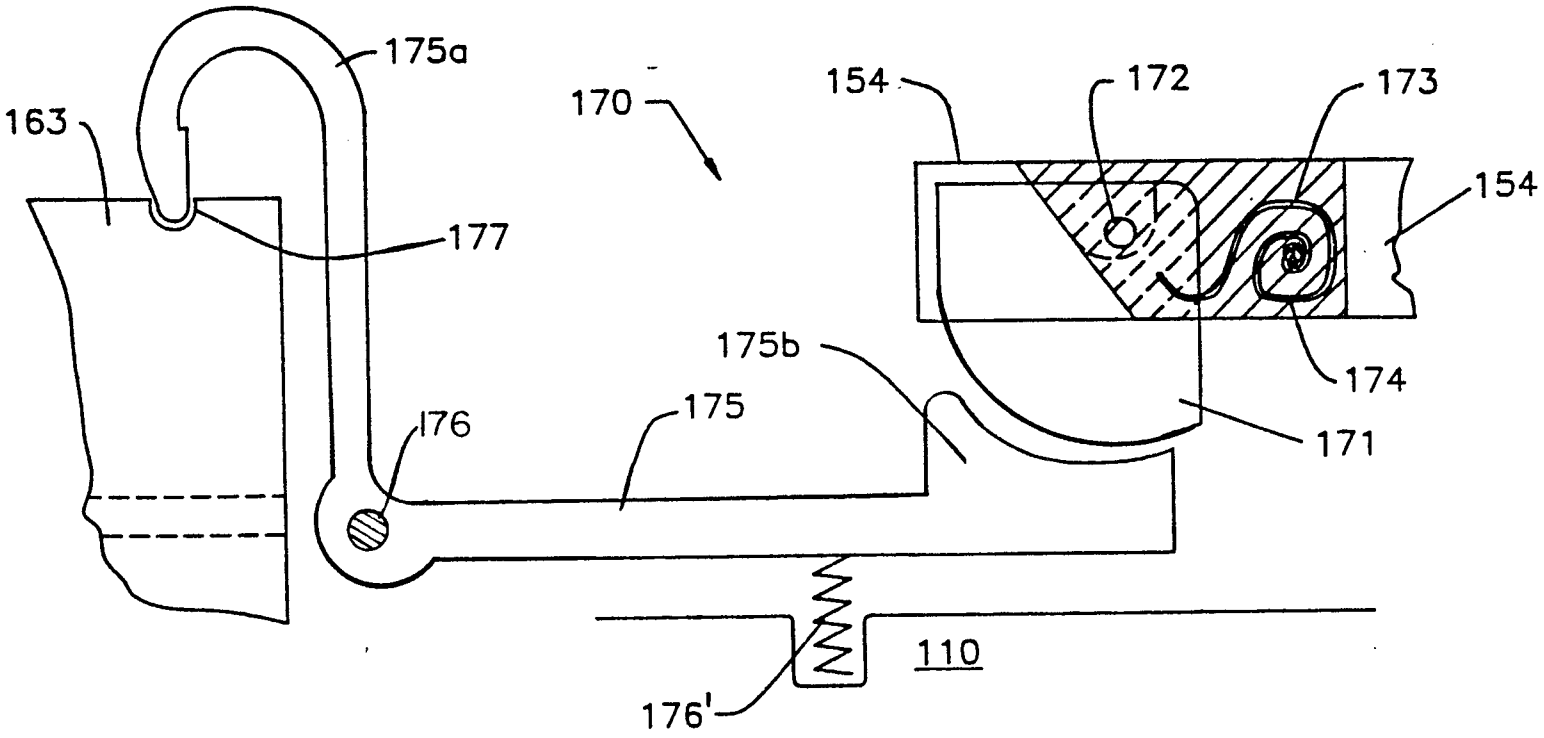
FIG. 5 is a detailed side view of the worm gear/drive finger of FIG. 4 showing a semi-cylinder/worm gear lock lever.

The magazine and rotating means are also typically under the control of a securing means which locks the uppermost segment in position for firing, and then unlocks the segment after firing to permit rotation of the belt and placement of another segment in position to permit firing of the cartridge contained therein. A preferred locking means is shown generally as 170 in FIG. 5, wherein a semi-cylinder finger 171 operates by means of its connection to the forward end of the lower linear gear bar 154. The semi-cylinder finger is pivotally attached to the forward end of the lower linear gear bar via semi-cylinder pin 172, which enables the semi-cylinder finger to rotate. As shown in FIG. 5, the semi-cylinder finger rotates clockwise and counterclockwise, with rotational tension being applied by means of a semi-cylinder finger retaining spring 173, which is attached to the lower linear gear bar by means of a spring retaining screw 174.

The semi-cylinder finger can also be seen to cooperate or nest with a complimentarily arcuate surface at the rear end of a worm gear lock lever 175. The worm gear lock lever has a forward portion **175*a* and a rear portion 175*b*. The forward portion may be pivotally affixed by means of a lock lever pin 176. The lock lever may be under tension by means of a lock lever spring 176', which may be adjustable to vary the tension and force necessary to unlock the segment and the force applied during relocking the next segment to be advanced. When the lock lever is unlocked by means of the semi-cylinder finger, the forward portion of the lock lever aligns with and cooperates with an index 177** to ensure proper alignment of the segment presented with the rear end of the barrel for firing of the cartridge contained therein. The preferred form of index is a depression or hole in the worm gear into which a point on the forward end of the lock lever may be inserted.

Figure 3:
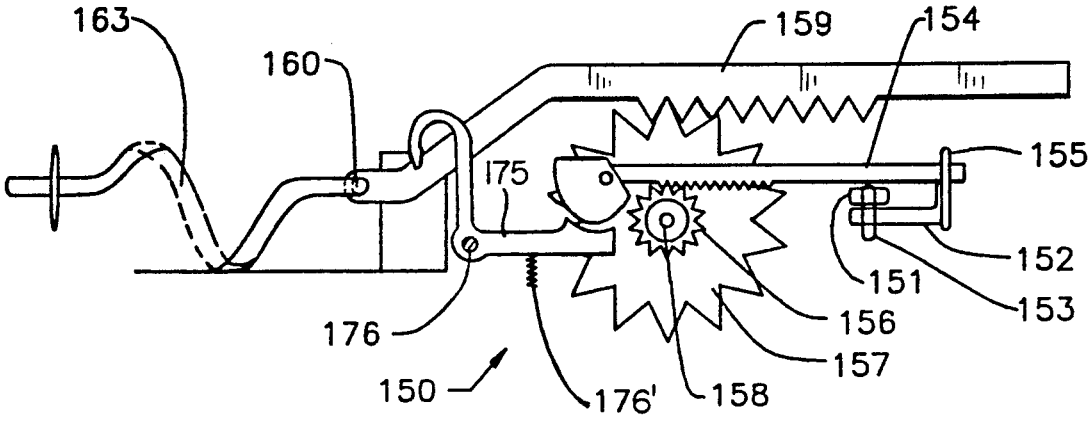
FIG. 3 is a detailed top view of the drive mechanism shown in FIG. 2.
Figure 4:
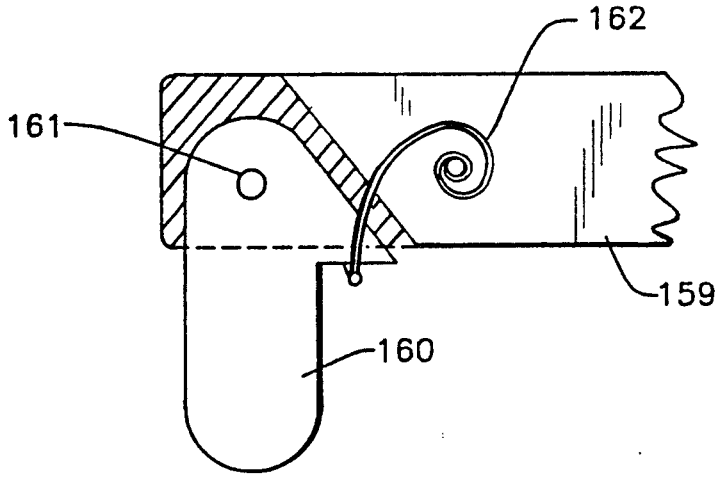
FIG. 4 is a detailed side view of the rotating means and securing means in the form of a preferred worm gear/drive finger.

As may be seen in FIG. 3, during the portion of the trigger pull that rotates the worm gear, the semi-cylinder finger has moved beyond the lip of the worm gear lock lever, and the worm gear lock lever is pushed by the lock lever spring such that the point on the worm gear lock lever pushes against the outer rim of the worm gear. As soon as the trigger pull has progressed a sufficient distance for the worm gear to transcribe a complete turn, with the next segment moved into position and the index in the worm gear has circled back to its starting point, the tooth engages the index locking the worm gear from further rotation and assuring accurate alignment of the cartridge segment with the barrel for the firing stage of the trigger pull. During the portion of the trigger pull that occurs after the worm gear has completed one full turn, and is locked, the groove in the worm gear has returned to the "straight portion". It is during this last portion of the trigger pull that the trigger gear releases the hammer, causing the hammer to strike the firing pin, which in turn strikes and fires the cartridge.

It will readily be noted by those of ordinary skill that the principal improvement over standard automatic clips is greater reliability without the likelihood of jamming, which occurs with automatic weapons almost twenty times more often than revolving weapons. Hence, even misfired cartridges do not render the weapon useless, since the magazine can be advanced to bypass the misfired cartridge in favor of a new cartridge.

The firing mechanism can be biased to an uncocked position if necessary to maximize safety, or can be rendered adjustable to facilitate a more rapid firing of the weapon.

During the release of the trigger, after the firing cycle as described above, the trigger return spring causes the lower linear gear bar to be pulled back to the starting position. In the return path of the worm gear drive finger, it reverse-traces the groove. When the portion of the groove is reached where the groove begins to transcribe its rotation around the circumference of the worm gear, the worm gear drive finger is unable to follow the groove, as in this direction, the worm gear is now locked by the worm gear lock lever. In the return direction, there is a ramp groove that the worm gear drive finger travels up. In this direction, the worm gear drive finger rotates clockwise, against the tension of the worm gear drive finger retaining spring up the ramp groove, thereby out of the groove and traces a path along the top surface of the worm gear. Towards the end of the trigger return, the worm gear drive finger reaches the beginning straight portion of the groove, and clicks back into the groove.

During the last portion of the trigger return, as shown in FIG. 3, the semi-cylinder finger mounted on the end of the lower linear gear bar has reached the point where it is in contact with the lip of the worm gear lock lever. In this direction, the semi-cylinder finger rotates clockwise, rising up and over the lip; it does not cause any rotation of the worm gear lock lever, leaving the worm gear locked. At the end of the trigger return, the semi-cylinder finger is beyond the lip, and rotates to return to the start position, ready for the next trigger pull cycle.

The magazine may be snapped into the firearm , e.g., by means of a twist lock, bead and seal or pressure release means. Upon inserting the magazine into the proper position, the attachment means holds the magazine in place. Upon releasing the magazine, it may be withdrawn from the weapon and a fresh magazine inserted. Thus reloading is simple and can be accomplished quickly.

In one alternative, the segments of the belt need not be pivotally attached to each other, and the magazine constructed such that the segments (cylinders) touch each other.

Figure 10:
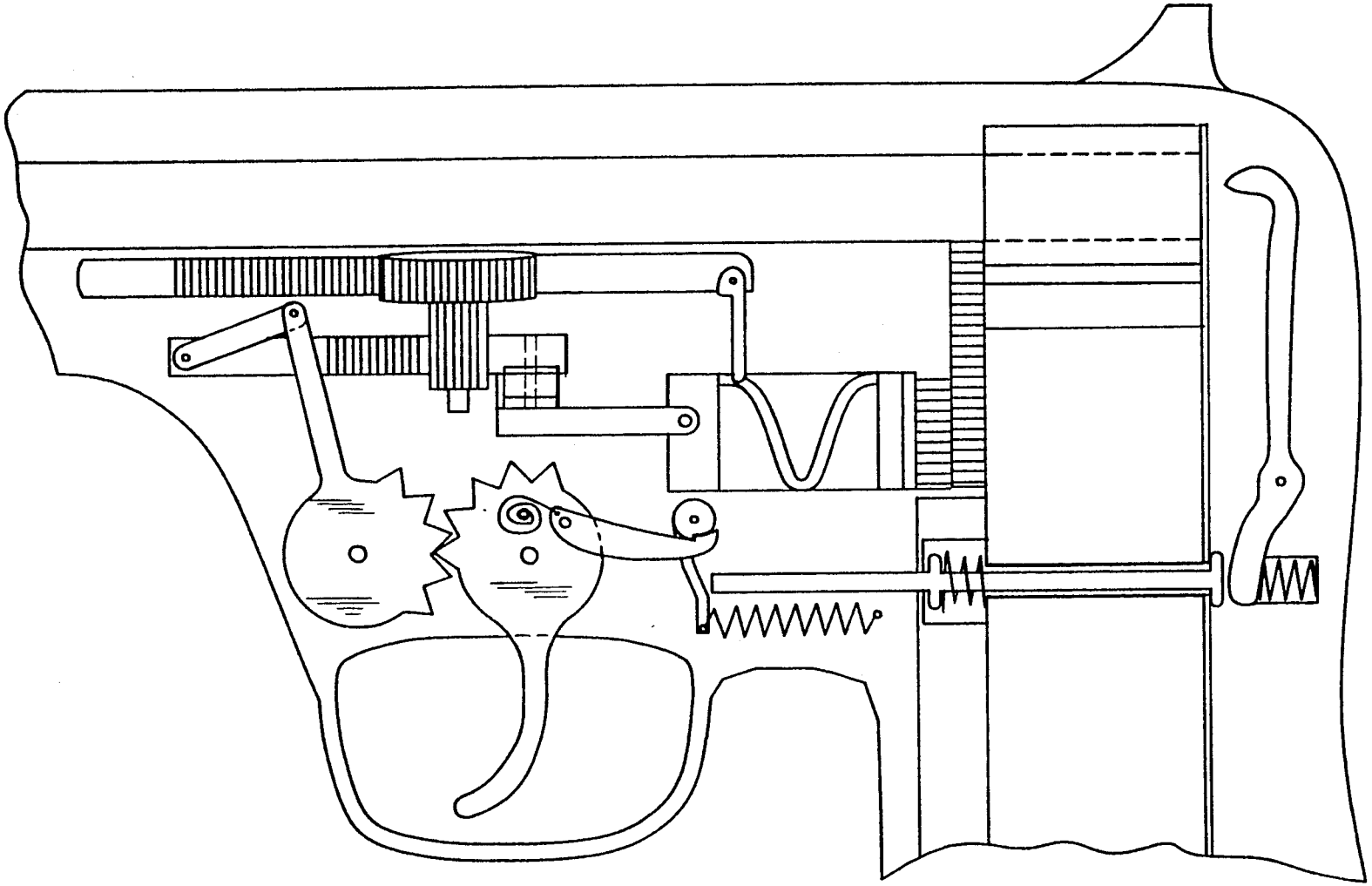
FIG. 10 is an alternative embodiment of the repeat firearm shown in FIG. 1 with the tractor clip mounted to the rear of the trigger assembly within the handle or grip.

In another alternative, the belt containing the segments can be situated in the butt or handle of the weapon. In this configuration, which is shown in FIG. 10, a "firing pin pass through means" can be included to transfer action to the firing pin behind the cartridge.

While certain preferred embodiments of the invention have been described herein in detail, numerous alternative embodiments are contemplated as falling within the scope of the claims appended hereto. Consequently, the scope of the invention in not limited to the specific embodiments addressed herein.

I claim:

1. A magazine for use in a firearm comprised of:
a casing having an inner surface and an outer surface;
an inner wall attached to the casing;
a belt rotatably mounted in said magazine between the inner surface of said casing and the inner wall, said belt being comprised of a plurality of segments, wherein the segments are pivotally attached to adjacent segments to form said belt, with one segment being in a position, relative to said firearm, when used with said firearm, for firing thereof; and wherein said one segment is in contact with adjacent segments during said firing, with said one segment and adjacent segments being sculpted, whereby said one segment intermeshes with the adjacent segments when said one segment is in the position, relative to said firearm, for firing thereof, and whereby said intermeshing prevents relative movement between said segments.

2. A magazine in accordance with claim 1 wherein the segments are pivotally and contiguously attached to adjacent segments to form said belt.

3. A magazine in accordance with claim 1 wherein said segments are formed with a chamber which is suited to accommodate a cartridge, and being shaped to assist in alignment with the barrel of a weapon during use.

4. A magazine in accordance with claim 1, wherein said intermeshed one segment and adjacent segments form a substantially solid semi-circular configuration.

5. A magazine in accordance with claim 1, wherein said intermeshed one segment and adjacent segments define a substantially circular configuration.

6. A magazine for use in a firearm comprised of:
a casing having an inner surface and an outer surface;
an inner wall attached to the casing;
a belt rotatably mounted in said magazine between the inner surface of said casing and the inner wall, said belt being comprised of a plurality of segments, wherein the segments are pivotally attached to adjacent segments to form said belt, with one segment being in a position, relative to said firearm, when used with said firearm, for firing thereof; and wherein said one segment is in contact with adjacent segments during said firing, wherein said one segment and adjacent segments are sculpted, whereby said one segment intermeshes with adjacent segments, and, wherein all of said plurality of segments are configured in the form of frusto-wedges to effect said intermeshing.

7. A magazine for use in a firearm comprised of:
a casing having an inner surface and an outer surface;
an inner wall attached to the casing;
a belt rotatably mounted in said magazine between the inner surface of said casing and the inner wall, said belt being comprised of a plurality of segments, with one segment being in a position, relative to said firearm, when used with said firearm, for firing thereof; and wherein said one segment is in contact with adjacent segments during said firing, with said one segment and adjacent segments being sculpted, whereby said one segment intermeshes with the adjacent segments when said one segment is in the position, relative to said firearm, for firing thereof, and whereby said intermeshing prevents relative movement between said segments.

* * * * *